US008502053B2

(12) United States Patent
Gustafson et al.

(10) Patent No.: US 8,502,053 B2
(45) Date of Patent: Aug. 6, 2013

(54) PICK FOR STRING INSTRUMENTS

(76) Inventors: Paul Richard Gustafson, Winnsboro, TX (US); James Harrell Cobb, Marshall, TX (US); Robert Eric Gustafson, Midlothian, TX (US)

( * ) Notice: Subject to any disclaimer, the term of this patent is extended or adjusted under 35 U.S.C. 154(b) by 0 days.

(21) Appl. No.: 13/317,417

(22) Filed: Oct. 17, 2011

(65) Prior Publication Data

US 2012/0090445 A1 Apr. 19, 2012

Related U.S. Application Data

(60) Provisional application No. 61/455,119, filed on Oct. 15, 2010.

(51) Int. Cl.
*G10D 3/16* (2006.01)

(52) U.S. Cl.
USPC ..... 84/322

(58) Field of Classification Search
None
See application file for complete search history.

(56) References Cited

U.S. PATENT DOCUMENTS

| | | | | | |
|---|---|---|---|---|---|
| 401,476 | A * | 4/1889 | Barnes | 84/322 |
| 413,579 | A * | 10/1889 | Stewart | 84/322 |
| 566,806 | A * | 9/1896 | Shearer | 84/322 |
| 584,653 | A * | 6/1897 | Sivils | 84/322 |
| 756,348 | A * | 4/1904 | Forney | 84/322 |
| 1,444,982 | A * | 2/1923 | Orth | 84/322 |
| 1,690,860 | A * | 11/1928 | Gonzalez | 84/322 |
| 1,741,285 | A * | 12/1929 | Carpenter | 84/322 |
| 3,650,172 | A * | 3/1972 | Osborne | 84/322 |
| 3,927,595 | A * | 12/1975 | Ferguson | 84/322 |
| 4,741,239 | A * | 5/1988 | Crafton | 84/322 |
| 4,843,942 | A * | 7/1989 | Ishizuka | 84/322 |
| 4,879,940 | A * | 11/1989 | Pereira | 84/322 |
| 5,323,677 | A * | 6/1994 | Knutson | 84/322 |
| 6,797,871 | B2 * | 9/2004 | Atkin | 84/322 |
| 7,162,827 | B1 * | 1/2007 | Yabusaki | 43/4 |
| 7,179,976 | B2 * | 2/2007 | West | 84/322 |
| 2002/0178891 | A1 * | 12/2002 | Atkin | 84/322 |
| 2003/0047058 | A1 * | 3/2003 | Pearson-Bey | 84/322 |
| 2006/0016455 | A1 * | 1/2006 | Ide | 132/200 |
| 2012/0090445 | A1 * | 4/2012 | Gustafson et al. | 84/322 |

* cited by examiner

*Primary Examiner* — David Warren
*Assistant Examiner* — Robert W Horn

(57) ABSTRACT

The invention is generally a pick apparatus for playing a stringed musical instrument having an elastic and generally cylindrically shaped cot having an opening and a tip, and has a substantially uniform thickness, as well as a pick capable of plucking a string of a musical instrument attached thereto proximate to the cot's hemisphere and extending beyond the hemisphere away from the cot such that the pick is capable of plucking a string of a musical instrument when the cot is being worn on a digit of a user.

2 Claims, 2 Drawing Sheets

PICK FOR STRING INSTRUMENTS

CLAIM OF PRIORITY

This Application claims priority to U.S. Provisional Patent Application No. 61/455,119 to common inventor Gustafson et al, dated 15 Oct. 2010 and entitled "'Ultimate' fingerpick: 'finger nailer' fingerpick 'awesome pluckers' fingerpick: fingerpicks to be used on stringed musical instruments."

FIELD OF THE INVENTION

The present invention relates to picks for stringed instruments.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

Picks for stringed instruments have been around since antiquity, and are a popular tool for giving an instrument a sound unique to each instrument and different from the sound that an instrument generates if it is being strummed. Popular picks are commonly held between one's thumb and forefinger; however, as picking has gained popularity "finger picking" has evolved to be a skill that is in demand. However, finger-picking, which involves plucking the strings with one's fingernails, tears up the nails and can lead to bleeding. Therefore, there is a need in the art for a device that enables finger-picking while reducing the likelihood of damage to a player's nails and fingers. The present invention is such a device.

BRIEF DESCRIPTION OF THE DRAWINGS

Various aspects of the invention, as well as an embodiment, are better understood by reference to the following detailed description. The detailed description, given by way of examples and not intended to limit the present invention solely thereto, will be better understood when read in conjunction with the drawings wherein like reference numerals denote like elements and parts in which.

EXEMPLARY EMBODIMENT OF A BEST MODE

Interpretation Considerations

Figure 1:
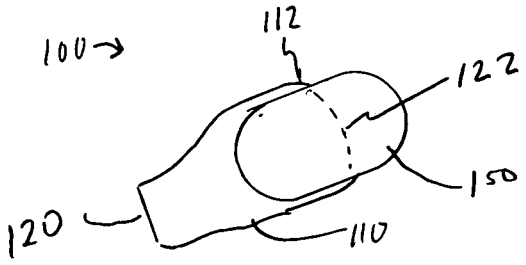
FIG. 1 is an isometric view of the preferred embodiment of the apparatus according to the teachings of the invention.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise. As will be understood by those of ordinary skill in the art, various structures and devices are depicted in block diagram form in order to avoid unnecessarily obscuring the invention.

It should be noted in the following discussion that acts with like names are performed in like manners, unless otherwise stated. Of course, the foregoing discussions and definitions are provided for clarification purposes and are not limiting. Words and phrases are to be given their ordinary plain meaning unless indicated otherwise.

Detailed Description of the Drawings

Figure 2:
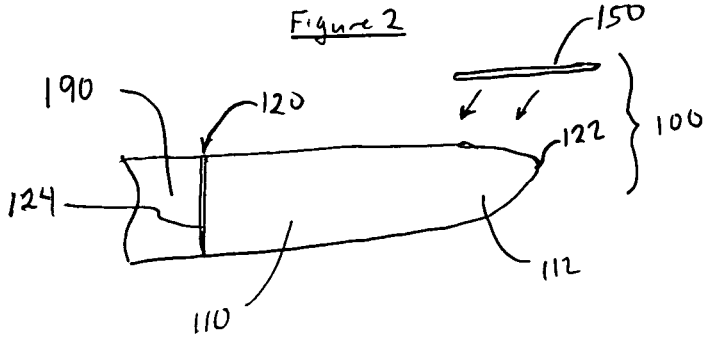
FIG. 2 is an exploded side view of the apparatus.
Figure 3:
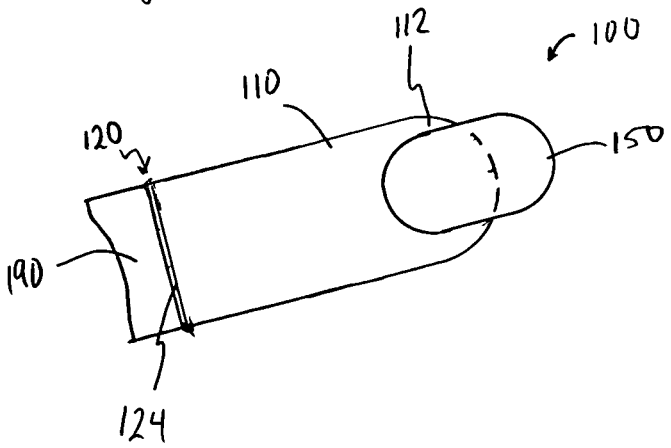
FIG. 3 is an isometric view of the apparatus disposed upon a finger.

FIG. 1 is an isometric view of the preferred embodiment of the apparatus according to the teachings of the invention, while FIG. 2 is an exploded side view of the apparatus. FIG. 3 is an isometric view of the apparatus disposed upon a finger. The following description is made in simultaneous reference to FIG. 1, FIG. 2, and FIG. 3. In a preferred embodiment the invention is a pick apparatus 100 for playing a stringed musical instrument, such as a guitar, banjo, harp, or violin, for example. As is most clearly seen in FIG. 2, the apparatus 100 includes a generally cylindrically shaped cot 110 terminating in a hemisphere 112 having a tip 122 and being shaped to tightly accommodate a human digit 190 therein.

The cot 110 is made of an elastic material that "hugs" the digit (finger or thumb) 190 of the user, such as rubber, nitrile material, latex or similar materials (herein, "cot" is used in the "sheath or protective covering" sense of the word, and not in its "bedding" sense). The cot 110 is in varying embodiments as long as the proximate, intermediate or distal portions of a human digit. The cot 110 has an opening 120 and a tip 122, and has a substantially uniform thickness, preferably ranging from 14 to 30 mils (thousandths of an inch). The cot 110 may be smooth and unbroken, perforated, or have breathing-holes. The opening 120 of the cot 110 is preferably reinforced via a rim 124 of the same material as the cot 110, and may be uniformly part of the cot 110, similar to the terminal stem of a balloon. The apparatus 100 also includes a pick 150 capable of plucking a string of a musical instrument.

The pick 150 is attached to the cot 110 proximate to the hemisphere 112 and extends beyond the hemisphere 112 away from the cot 110 such that the pick 150 is capable of plucking a string of a musical instrument when the cot is being worn on a digit of a user. The pick may comprise an organic material such as animal bone, shell, wood, or other plant material or animal material. Additionally, the pick may comprise inorganic material, such as nylon, metal, resin, porcelain, plastic, thermoplastic, graphite, epoxy, fiberglass, glass, or stone, for example.

The pick is preferably fingernail-shaped. However, the pick may incorporate any number of shapes in order to "draw out" different sounds from the instrument being played or for purely ornamental reasons. In one embodiment, the pick may be substantially shaped as an entire distal portion of a finger having a fingernail.

The cot 110 and pick 150 are attached with an adhesive, such as a cyanoacrylate, or polyurethane, for example, and the area of the cot 110 to which the pick 150 attaches is defined as an adhesion area. Alternatively, the pick 150 is attached to the cot 110 via a fusing bonding agent.

Figure 4:
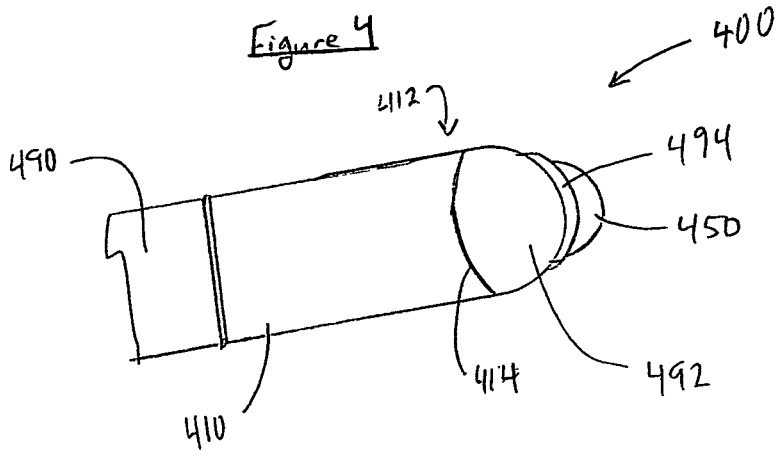
FIG. 4 is bottom-up view of an alternative embodiment of the invention having a tip removed therefrom.

FIG. 4 is bottom-up view of an alternative embodiment of the invention having a tip (such as the tip 122) removed therefrom, which is an alternative pick apparatus 400 for playing a stringed musical instrument. The apparatus 400 has a generally cylindrically shaped cot 410 terminating generally in a truncated hemisphere 412. The cot 410 is shaped to tightly accommodate a human digit 490. To accomplish this, the cot 410 is made of an elastic material, and has a tip-opening 414 through which is exposed a distal tip of a digit 492 when worn by a user, potentially exposing a user's fingernail 494. A pick 450 capable of plucking a string of a musical instrument is attached to the cot 410 proximate to the tip-opening 414 and extending beyond the tip-opening 414 away from the cot 410 such that the pick 450 is capable of plucking a string of a musical instrument when the cot is being worn on a digit 490 of a user. Although not shown in FIG. 4, the pick 450 couples to the cot 410 in a manner described above with reference to FIGS. 1-3. Further, each variation described in FIGS. 1-3 may be incorporated into the embodiment described in FIG. 4.

Furthermore, though the invention has been described with respect to a specific preferred embodiment, many advantages, variations and modifications will become apparent to those skilled in the art upon reading the present application. It is therefore the intention that the appended claims and their equivalents be interpreted as broadly as possible in view of the prior art to include all such variations and modifications.

We claim:

1. A pick apparatus for playing a stringed musical instrument, comprising:

a generally cylindrically shaped cot terminating in a hemisphere being shaped to tightly accommodate a human digit;

the cot comprising an elastic material;

the cot has an opening and a tip, and has a substantially uniform thickness;

a pick capable of plucking a string of a musical instrument; the pick being attached to the cot proximate to the hemisphere and extending beyond the hemisphere away from the cot such that the pick is capable of plucking a string of a musical instrument when the cot is being worn on a digit of a user;

wherein the cot is at least as long as the intermediate and distal portions of a human digit.

2. A pick apparatus for playing a stringed musical instrument, comprising:

a generally cylindrically shaped cot terminating in a hemisphere being shaped to tightly accommodate a human digit;

the cot comprising an elastic material;

the cot has an opening and a tip, and has a substantially uniform thickness;

a pick capable of plucking a string of a musical instrument; the pick being attached to the cot proximate to the hemisphere and extending beyond the hemisphere away from the cot such that the pick is capable of plucking a string of a musical instrument when the cot is being worn on a digit of a user;

wherein the cot is as long as the proximate, intermediate and distal portions of a human digit.

* * * * *